US006671982B2

(12) United States Patent
Caeran

(10) Patent No.: US 6,671,982 B2
(45) Date of Patent: Jan. 6, 2004

(54) SHELL, PARTICULARLY FOR A SKI BOOT

(75) Inventor: Francesco Caeran, Montebelluna (IT)

(73) Assignee: Benetton Group S.p.A., Ponzano Veneto (IT)

( * ) Notice: Subject to any disclaimer, the term of this patent is extended or adjusted under 35 U.S.C. 154(b) by 144 days.

(21) Appl. No.: 09/797,718

(22) Filed: Mar. 5, 2001

(65) Prior Publication Data

US 2001/0022040 A1 Sep. 20, 2001

(30) Foreign Application Priority Data

Mar. 14, 2000 (IT) ..... MI2000A0519
Mar. 14, 2000 (IT) ..... MI2000A0518

(51) Int. Cl.[7] ..... A43B 5/00
(52) U.S. Cl. ..... 36/117.1; 36/118.2
(58) Field of Search ..... 36/117.1, 118.2, 36/50.5, 118.9, 118.7

(56) References Cited

U.S. PATENT DOCUMENTS 5,197,209 A * 3/1993 Rolland et al. ..... 36/118.9
5,272,823 A * 12/1993 Perrissoud ..... 36/117.7
5,381,612 A * 1/1995 Paris ..... 36/117.7
5,410,822 A * 5/1995 Vaccari ..... 36/117.1
5,519,951 A 5/1996 Paris
5,553,400 A * 9/1996 Wittmann et al. ..... 36/117.1
5,592,758 A 1/1997 Iwama et al.

FOREIGN PATENT DOCUMENTS

EP 0 123 636 10/1984
EP 0 752 215 1/1997

* cited by examiner

*Primary Examiner*—M. D. Patterson
(74) *Attorney, Agent, or Firm*—Guido Modiano; Albert Josif; Daniel O'Byrne

(57) ABSTRACT

A shell, particularly for a ski boot, constituted by a box-like main body which is open in an upward region and is rigidly coupled to a sole. The shell has, at the foot instep region, two arc-like partially overlapping plates, each of which is rotatably pivoted to the shell by pivots arranged laterally to the shell on an axis which is approximately parallel to the resting plane of the sole. The rotation of the two plates is limited by a pivot and slot connection arranged in the region in front of the heel.

25 Claims, 13 Drawing Sheets

SHELL, PARTICULARLY FOR A SKI BOOT

BACKGROUND OF THE INVENTION

The present invention relates to a shell, particularly for a ski boot.

The manufacture of boots having overlapping flaps has been widespread for several years.

According to such technology, a significant portion of the surface of the flaps overlaps; after the boot is fastened, the flaps ensure an optimum wraparound effect and watertightness of the boot.

The boots are generally made of plastics and are therefore manufactured by injecting melted material into the mold.

During sports practice, the boot must ensure the structural strength required to correctly control the ski and at the same time ensure that there are no infiltrations of water toward the foot.

These two characteristics greatly influence the manufacture of the boot, because structural strength requires components of considerable thickness and stiffness, while watertightness and comfort require a reduced thickness in order to have a structure which is flexible and can easily shape itself to fit the foot.

During the insertion and extraction of the foot from the boot, the structure must undergo deformation without preventing or hindering the sliding of the foot in the boot; in particular, the two flaps must undergo deformation and slide with respect to each other.

This last action is also affected by the friction generated between the mutually contacting surfaces of the two flaps.

All this usually entails the manufacture of a plastic boot whose characteristics are a compromise and only partially satisfy the above described requirements.

Ski boots with scarcely flexible flaps, which allow limited shaping and afford good retention of the foot but compromise excessively the insertion and extraction of the foot, which are generally difficult and entail forcing, are in fact commonly manufactured.

Moreover, skiing is rather uncomfortable in pauses between a downhill run and the next one or whenever one has to move without wearing skis on one's feet, since some difficulty in walking is observed.

U.S. Pat. No. 5,553,400 discloses a ski boot of the overlapping-flap type having a sole, an overlying body which is open at the front, and an open region, located at the foot instep, in which there are two pressure distribution plates arranged on the outer surface of the frontally open body.

The two plates run from the region of the boot tip to beyond the open region, where they bend upward, and are associated at the open region of the foot instep so that they can perform a longitudinal translatory motion with respect to the frontally open body and move transversely to the axis of the boot. They can also overlap so as to close the open region and the frontally open body.

In the boot, at least one of said pressure distribution plates must be rotatably associated by virtue of at least one fixed hinge which is arranged laterally to the open region of the foot instep.

The fixed hinge thus allows the rotary motion of one plate away from the other plate, so as to facilitate the opening of the foot instep region and of the open body.

When the boot is opened, the plates perform an outward combined rotary and translatory motion, moving mutually apart and also diverging and lifting, in their motion, the two partly overlapping flaps of the boot.

The main drawback of this conventional type of ski boot is the fact that user must apply, while inserting the foot, a force which is proportional to the opening of the flaps and is required in order to overcome the friction between the various surfaces involved.

Another drawback is the fact that some ski boots are constituted by a shell which is structurally weak because it is constituted by many mutually interacting parts.

For the same reason, the cost of manufacturing the shell is high because the shell is structurally complex.

SUMMARY OF THE INVENTION

The aim of the present invention is therefore to solve the noted technical problems, eliminating the drawbacks of the cited prior art, by providing a ski boot shell which increases the passage space for foot insertion and extraction so as to allow easy entries and exits of the foot with respect to the ski boot.

An important object is to provide a ski boot shell which achieves the intended aim without increasing the user's insertion effort.

Another important object is to provide a ski boot shell which allows to use a small number of plates, thus reducing manufacturing costs and increasing the structural strength of the entire shell.

Another object is to provide a ski boot shell which improves the wraparound effect on the foot in the boot.

Another object is to provide a ski boot shell which is structurally simple and has low manufacturing costs.

This aim and these and other objects which will become better apparent hereinafter are achieved by a shell, particularly for a ski boot comprising a main body which is open in an upward region, characterized in that it comprises, at the foot instep region, two partially overlapping plate portions, each of said plate portions being rotatably pivoted to said shell by means of first rotary connection means arranged laterally to said shell on an axis which is approximately parallel to the resting plane of said sole, the rotation of said two plate portions being limited by second guided connection means arranged in the region in front of the heel.

BRIEF DESCRIPTION OF THE DRAWINGS

Further characteristics and advantages of the present invention will become better apparent from the following detailed description of some embodiments thereof, illustrated by way of non-limitative example in the accompanying drawings, wherein.

DESCRIPTION OF THE PREFERRED EMBODIMENTS

Figure 1:
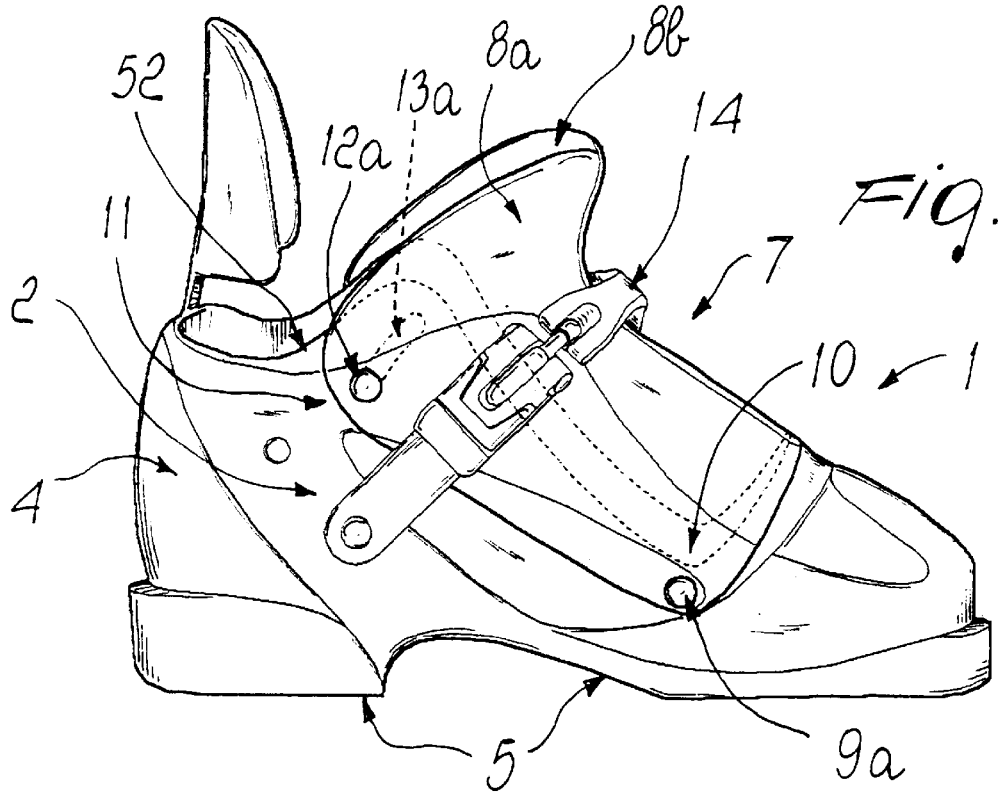
FIGS. 1 and 2 are side views of a shell of a ski boot according to the invention, respectively in the closed position and in the open position.
Figure 2:
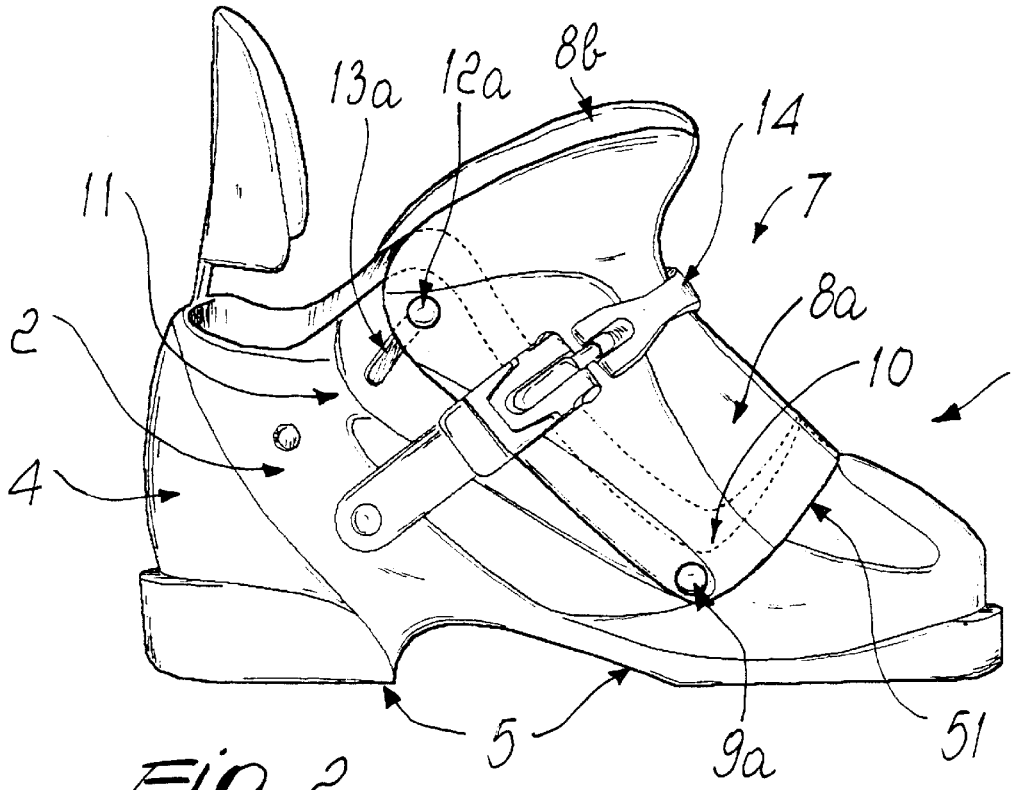
Figure 3:
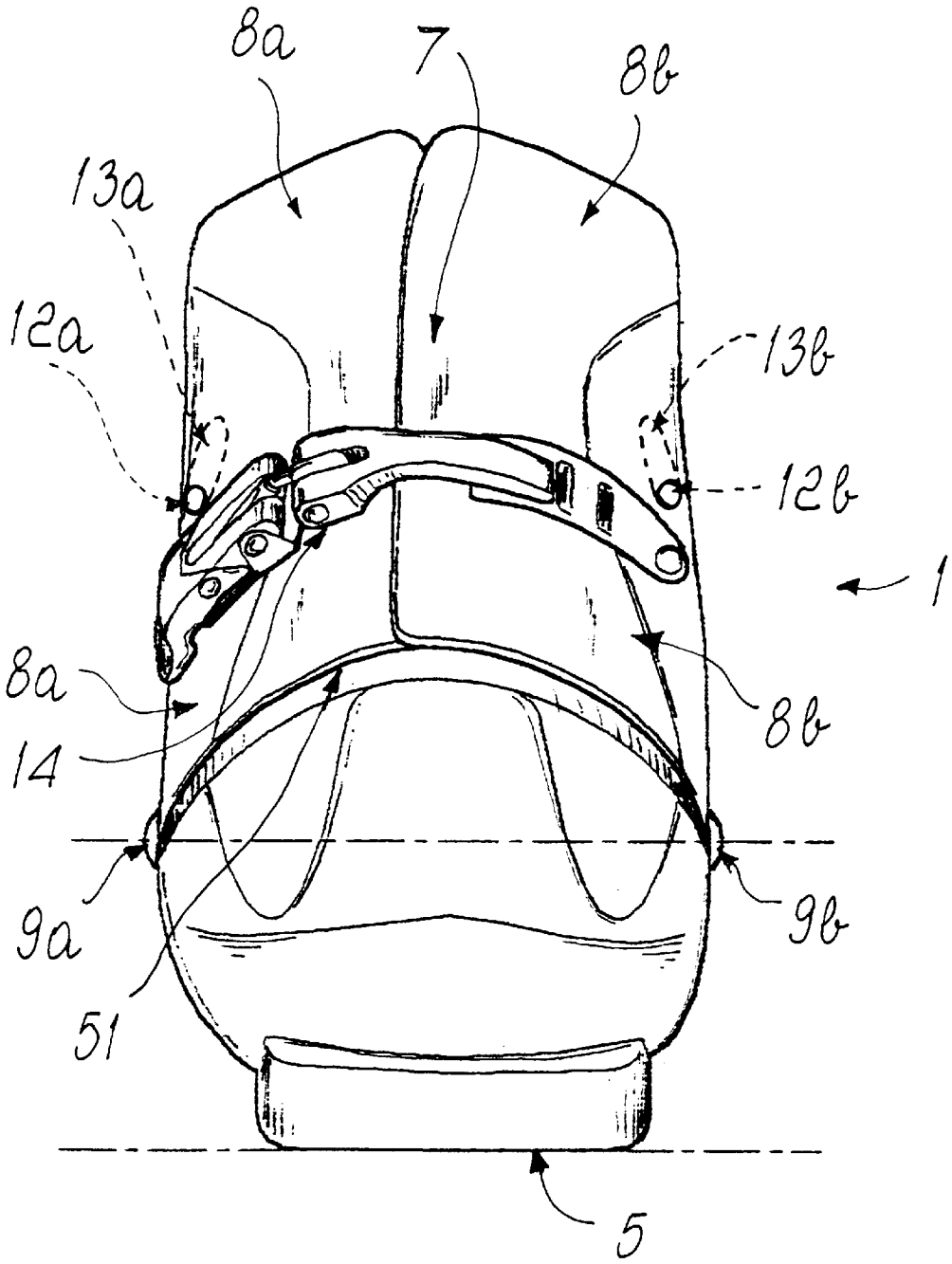
FIG. 3 is a front view of the shell of the preceding figures.

With reference to the figures, the numeral 1 designates a shell which is particularly usable for a ski boot.

The shell 1 is constituted by a main body, designated by the reference numeral 2, which is box-shaped, is open in an upward region, and is rigidly coupled, in a downward region, to a standardized sole, designated by the reference numeral 5.

The shell 1 has, at the foot instep, designated by the reference numeral 7, two plates 8*a* and 8*b* which are arc-like, partially overlap each other and are arranged so as to partially close the upper part of said main body 2.

Each of the two plates 8*a* and 8*b* is rotatably pivoted to said shell by first rotary connection means which are constituted, in this embodiment, by two hinges which are constituted by first pivots, designated by the reference numerals 9*a* and 9*b*, which are arranged laterally to the shell 1 on an axis which is approximately parallel to the resting plane of the sole 5 and adjacent to the front perimetric edge 51 of each plate in a region 10 which is adjacent to the sole 5.

Each of the two plates 8*a* and 8*b* is limited in its forward rotation by the presence of second guided connection means which are arranged in front of the heel 4 approximately in the malleolar region 11.

Said second guided connection means are constituted by two second pivots, designated by the reference numerals 12*a* and 12*b*, which are associated with the respective plates 8*a* and 8*b* and can slide within two respective slots, designated by the reference numerals 13*a* and 13*b* respectively, which are formed at the malleolar region 11 of said main body 2.

Each of said slots 13*a* and 13*b* has a plan shape which is rectangular or arc-like and preferably centered at the hinge 9*a* and 9*b*, thus allowing the plates 8*a* and 8*b* to rotate through a certain angle formed by the ends of said slots 13*a* and 13*b* about said two hinges 9*a* and 9*b*.

The two plates 8*a* and 8*b* can be fastened to the main body 2 by means of a first closure device, designated by the reference numeral 14, which may be constituted by conventional mechanical means, such as one or more closure levers.

Figure 4:
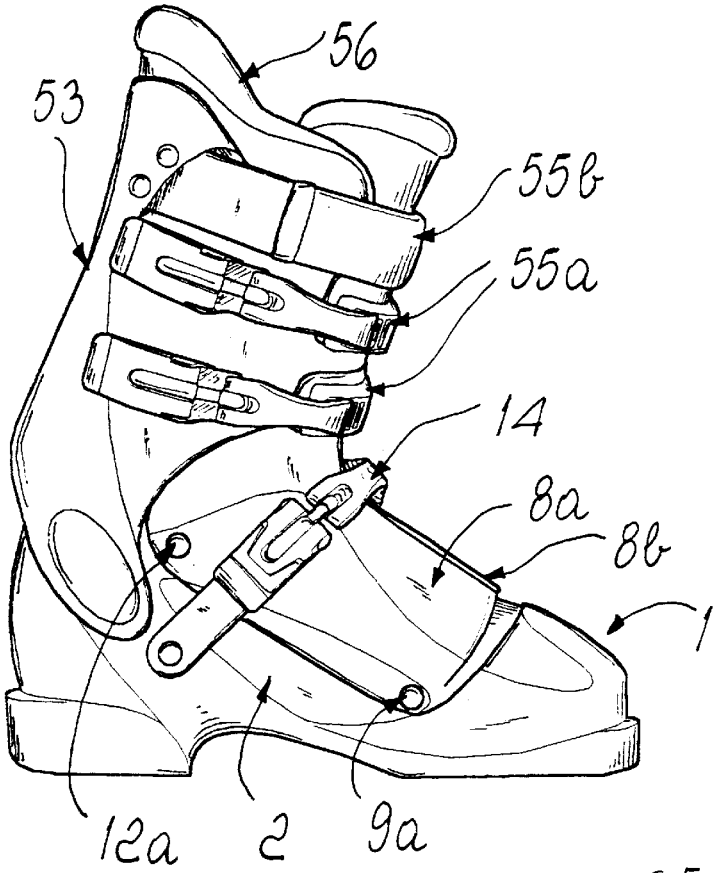
FIGS. 4 and 5 are side views of a boot provided with the shell, according to the invention, shown in the closed position and in the open position, respectively.
Figure 5:
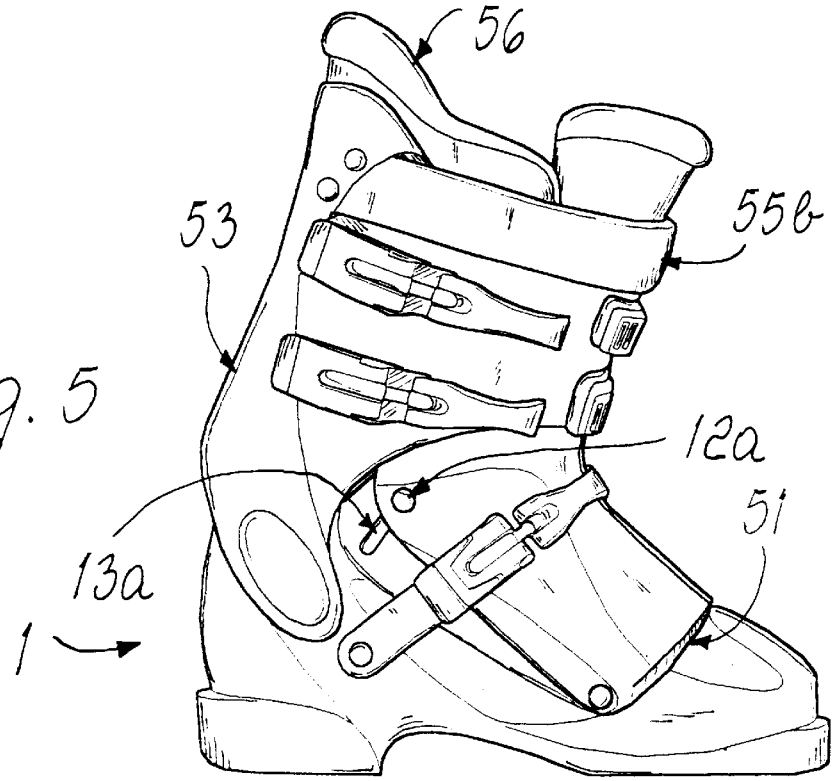

A quarter, designated by the reference numeral 53 in FIGS. 4 and 5, for surrounding the calf and tibia regions is rotatably associated above the shell 1.

The quarter 53 can be fastened by means of second and third closure devices, designated by the reference numerals 55*a* and 55*b*.

During opening, the quarter 53 can rotate backward in order to further facilitate the insertion of the foot in the boot.

A soft innerboot for foot containment, designated by the reference numeral 56, is arranged inside said shell 1 and said quarter 53.

Figure 6:
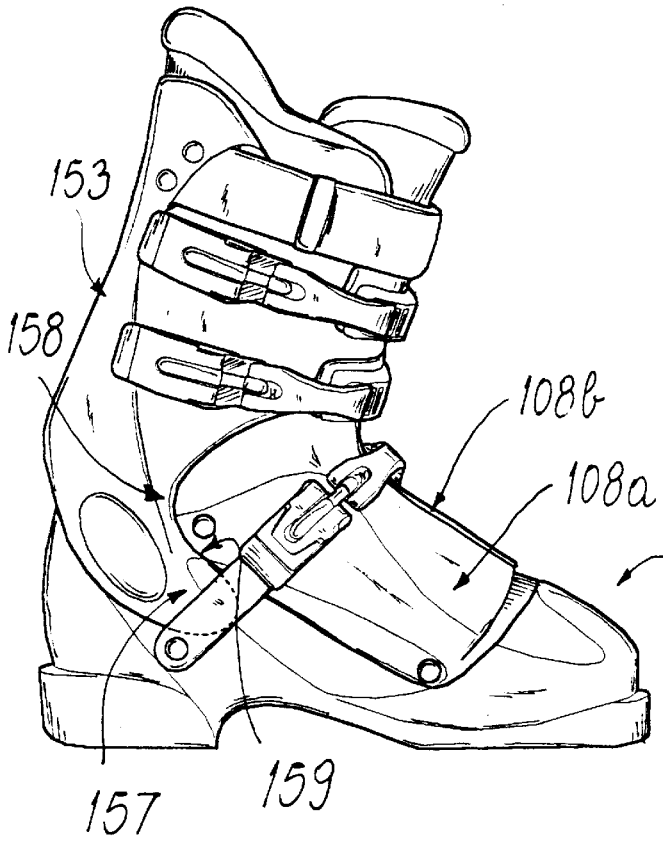
FIGS. 6 and 7 are side views of a boot, according to a second aspect of the invention, shown in the closed position and in the open position, respectively.
Figure 7:
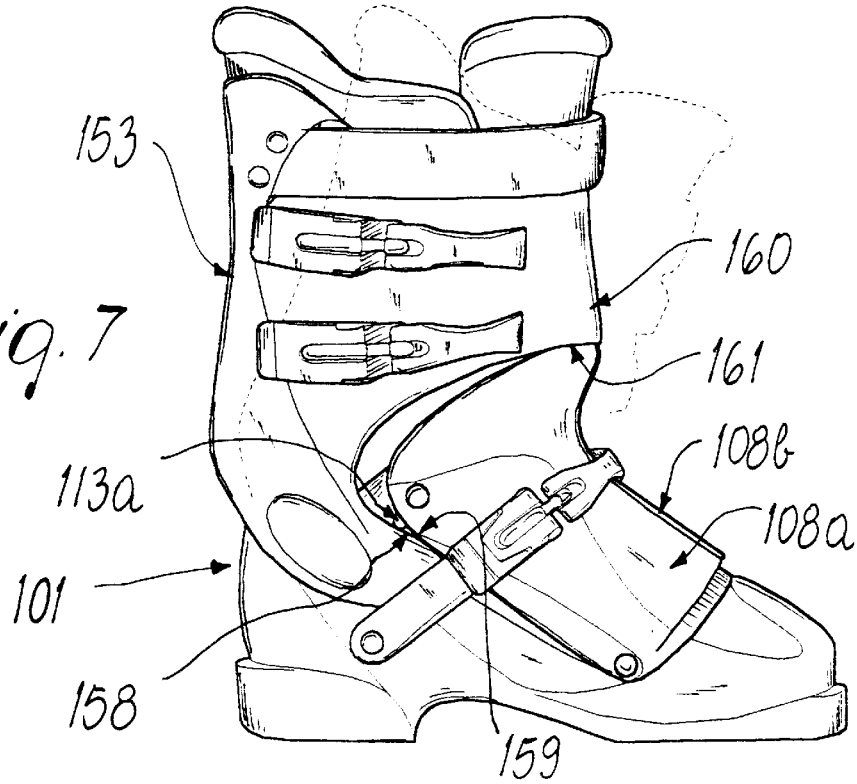
Figure 8:
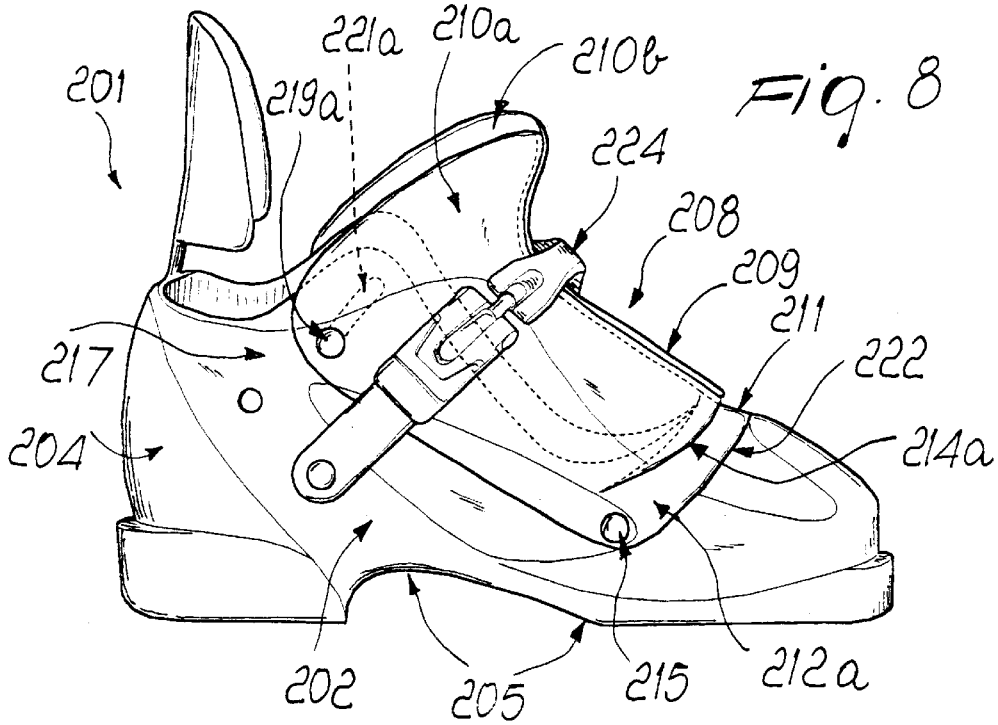
FIGS. 8 and 9 are side views of a shell of a ski boot according to the invention, shown respectively in the closed position and in the open position.
Figure 9:
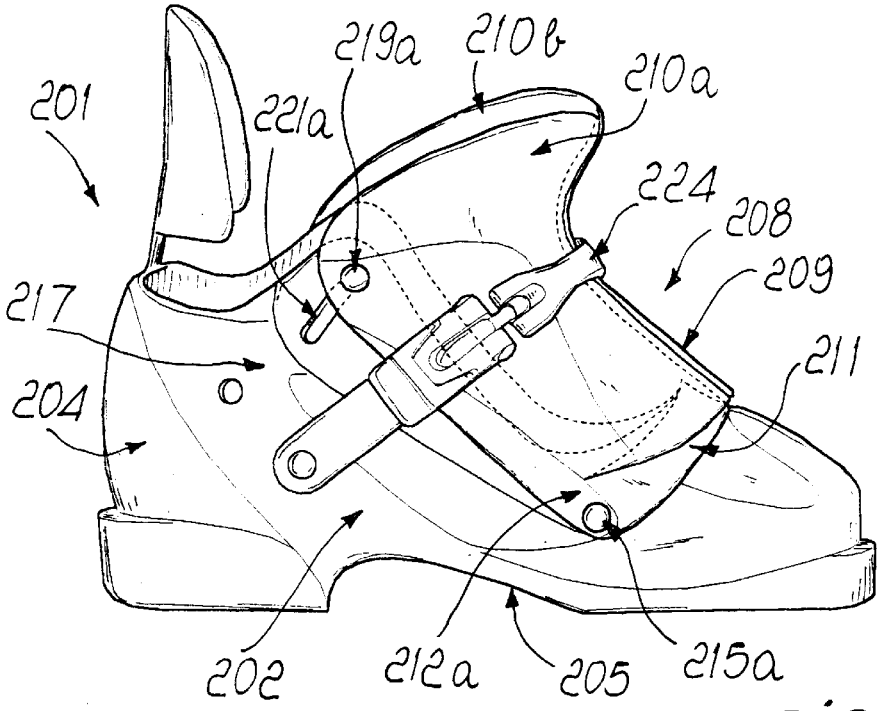
Figure 10:
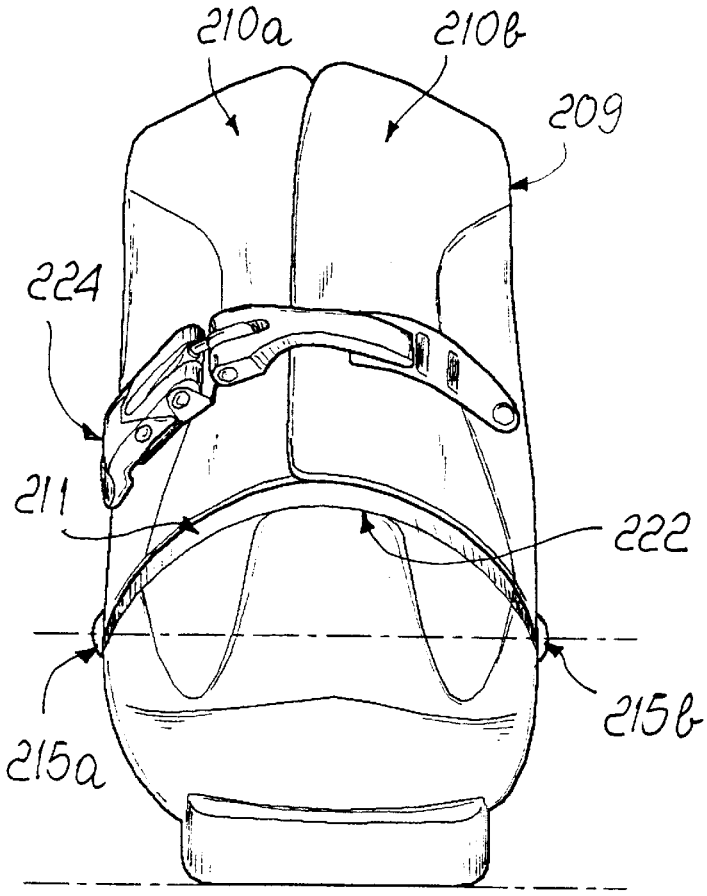
FIG. 10 is a front view of the shell of FIGS. 8, 9.
Figure 11:
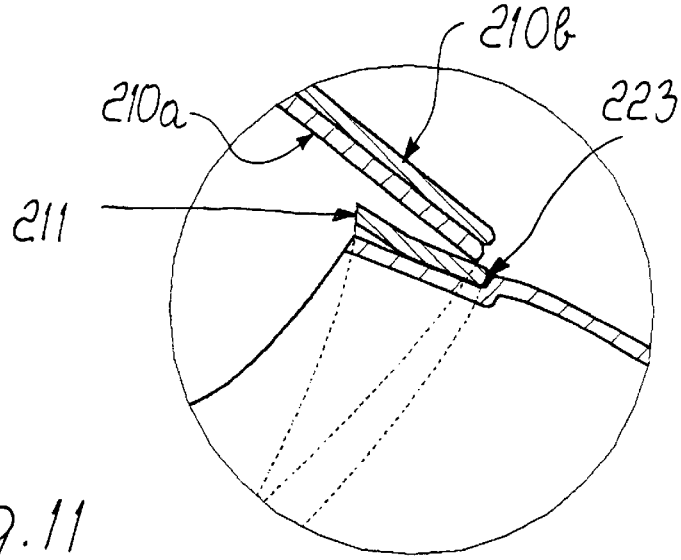
FIG. 11 is a side section view of a detail of FIG. 10.
Figure 12:
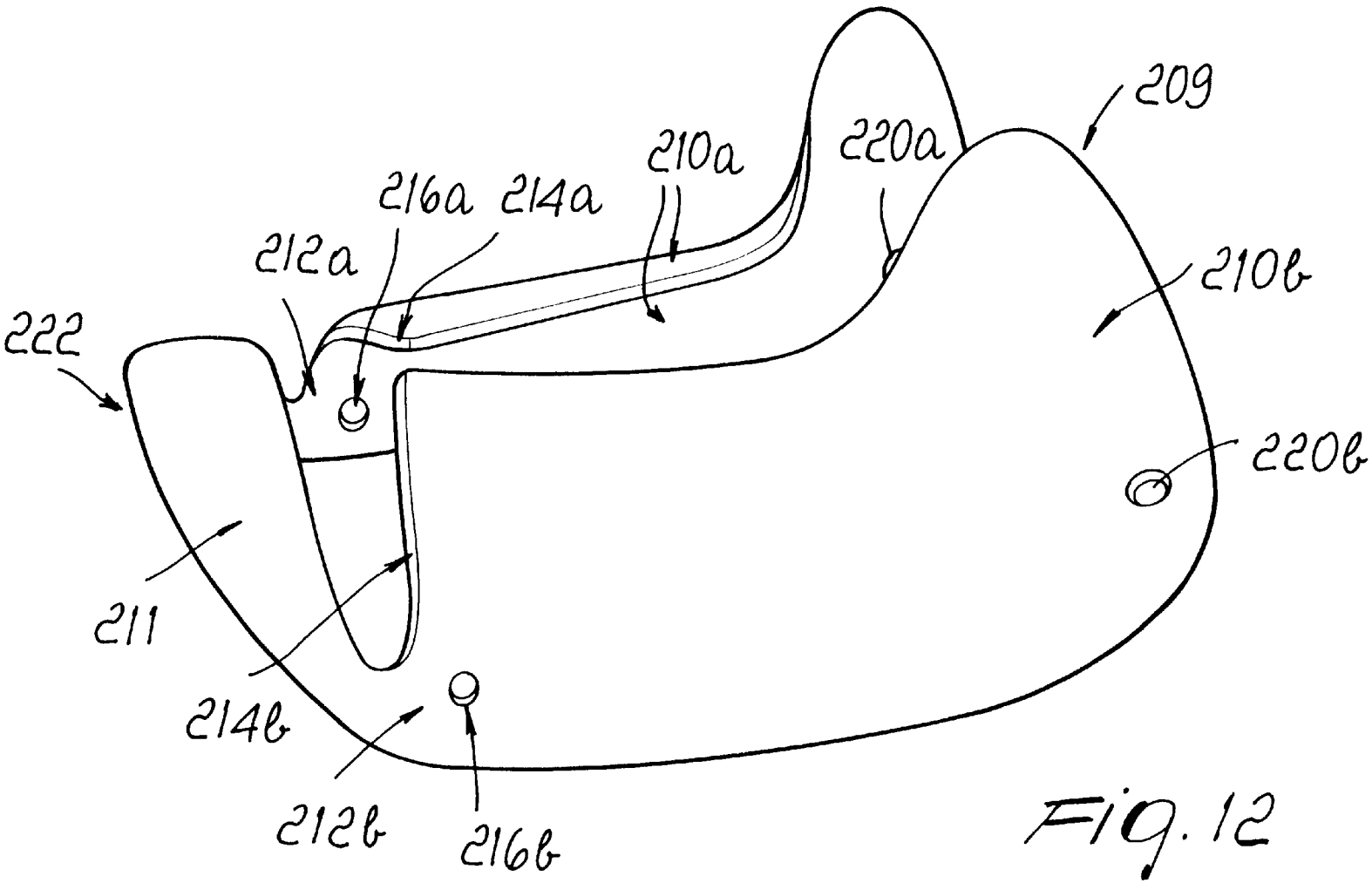
FIG. 12 is a perspective view of the plate of the shell of FIGS. 8–11.

FIGS. 6 and 7 illustrate a second embodiment of a quarter, designated by the reference numeral 153, which is associable with a shell 101.

Appropriate lifting and rotation means, designated by the reference numeral 157, for two plates 108*a* and 108*b* are formed on the quarter 153 below the point where pivoting to the shell 101 occurs and proximate to the slots designated by the reference numerals 113*a* and 113*b*.

The lifting and rotation means 157 are constituted by two protrusions which protrude toward the tip of said shell 101 and whose upper perimetric edge, designated by the reference numeral 158, is arranged in contact with the facing lower perimetric edge 159 of said two plates 108*a* and 108*b*.

The lifting and rotation means can be activated by arranging the quarter 153 vertically. The quarter can be locked in this position by resting the lower end, designated by the reference numeral 160, on the upper end 161 of said two plates 108*a* and 108*b*.

Operation is thus as follows: with reference to the above cited figures, the foot of the user can be easily inserted in the boot simply by disengaging the closure devices 14, 55*a* and 55*b*. The first pressure applied by the foot, as it enters, causes the mutual spacing of the two plates 8*a* and 8*b* and simultaneously lifts said plates about the hinges 9*a* and 9*b*.

The dual movement of the plates provides, without excessive efforts, a wide opening for the access of said foot.

Once the foot has been inserted, by acting on said closure devices, the second pivots 12*a* and 12*b* are returned toward the lower ends of the slots 13*a* and 13*b* while increasing the overlap of the two plates 8*a* and 8*b*.

FIGS. 6 and 7 show a ski boot provided with a quarter 153. The ski boot provided with the second embodiment of the quarter 153, shown in FIGS. 6 and 7, is even easier to put on, because the rotation of the quarter 153 in the vertical position entails the lifting and simultaneous rotation of the plates 108*a* and 108*b* on the part of the two protrusions that constitute said lifting and rotation means.

It has thus been observed that the invention has achieved the intended aim and objects, a shell having been devised which increases the passage space for foot insertion and extraction so as to allow easy and quick entries and exits of the foot into and out of the ski boot.

The ski boot shell according to the invention is susceptible of numerous modifications and variations, within the scope of the appended claims.

For example, with reference to FIGS. 8–14, the numeral 201 designates a shell which is particularly usable for a ski boot which is not shown in full in the figures.

The shell 201 is constituted by a main body, designated by the reference numeral 202, which is box-shaped, is open in an upward region, and is rigidly coupled, in a downward region, to a standardized sole, designated by the reference numeral 205.

A single plate 209 is associated with the shell 201 at the foot instep, designated by the reference numeral 208. The plate is composed of two flaps, designated by the reference numerals 210*a* and 210*b*, which are arc-like, can partially overlap each other and are arranged so as to partially close the upper part of said main body 202.

Each of said two flaps 210*a* and 210*b* is transversely connected to the other one, at the front, by means of a bridge, designated by the reference numeral 211, which is arc-like and elastically deformable.

Bridge 211 is connected, at its lateral ends, to each of said two flaps 210*a* and 210*b,* at connection regions 212*a* and 212*b* obtained at the ends of the front perimetric edges 214*a* and 214*b* which cannot overlap.

In this manner, front perimetric edges 214*a* and 214*b* can be arranged, in the mutual overlap region, on top of part of said bridge by the elastic deformation thereof in the connection regions 212*a* and 212*b.*

The two flaps 210*a* and 210*b* are associated with shell 201 by means of first connection means which are constituted, in this embodiment, by two first fixed pivots, designated by the reference numerals 215*a* and 215*b,* which are arranged within two respective first through holes 216*a* and 216*b* formed laterally to the shell 201, proximate to the connection regions 212*a* and 212*b.*

Each of said two flaps 210*a* and 210*b* is limited in its forward rotation by the presence of second guided connection means which are located in front of the heel 204, approximately in the malleolar region 217.

The second guided connection means is constituted by two second pivots, designated by the reference numerals 219*a* and 219*b,* which are associated with the respective flaps 210*a* and 210*b* at two second through holes 220*a* and 220*b* and can slide within two respective slots, designated by the reference numerals 221*a* and 221*b* respectively, which are formed proximate to the malleolar region 217.

Each of said slots 221*a* and 221*b* has a plan shape which is rectangular or arc-like and preferably centered at said first fixed pivots 215*a* and 215*b,* thus allowing the flaps 210*a* and 210*b* to rotate through a certain angle formed by the ends of said slots 221*a* and 221*b* about the two first fixed pivots 215*a* and 215*b.*

The forward rotation of the flaps 210*a* and 210*b* is allowed by the deformability of bridge 211 proximate to the connection regions 212*a* and 212*b,* because the bridge is not only rigidly coupled to the main body 202 by the first fixed pivots 215*a* and 215*b* but its front side, designated by the reference numeral 222, abuts against a suitable recess 223 of said shell 201.

The two flaps 210*a* and 210*b* can be fastened to the main body 202 by means of a first closure device, designated by the reference numeral 224, which can be constituted by conventional mechanical means, such as one or more closure levers.

Figure 13:
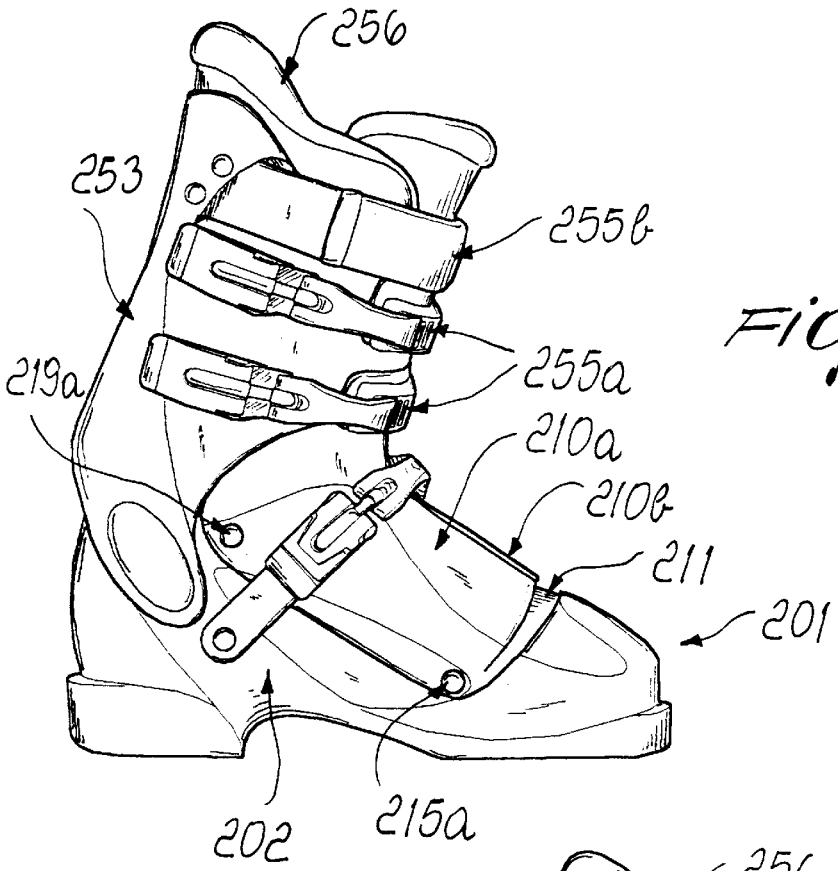
FIGS. 13–14 are side views of a ski boot, having the shell illustrated in FIGS. 8–12, shown respectively in the closed position and in the open position.
Figure 14:
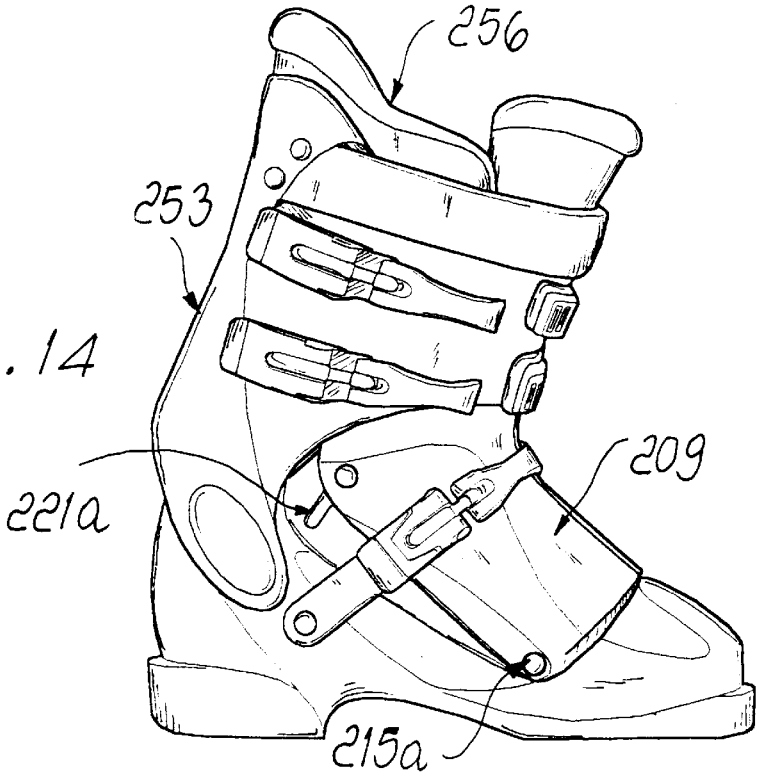

A quarter, designated by the reference numeral 253 in FIGS. 13 and 14, for surrounding the calf and tibia regions is rotatably associable above said shell 201.

The quarter 253 can be fastened by means of second and third closure devices, designated by the reference numerals 255*a* and 255*b.*

During opening, the quarter 253 can rotate backward in order to further facilitate the insertion of the foot in the boot.

A soft innerboot for containing the foot, designated by the reference numeral 256, is arranged inside shell 201 and quarter 253.

Figure 15:
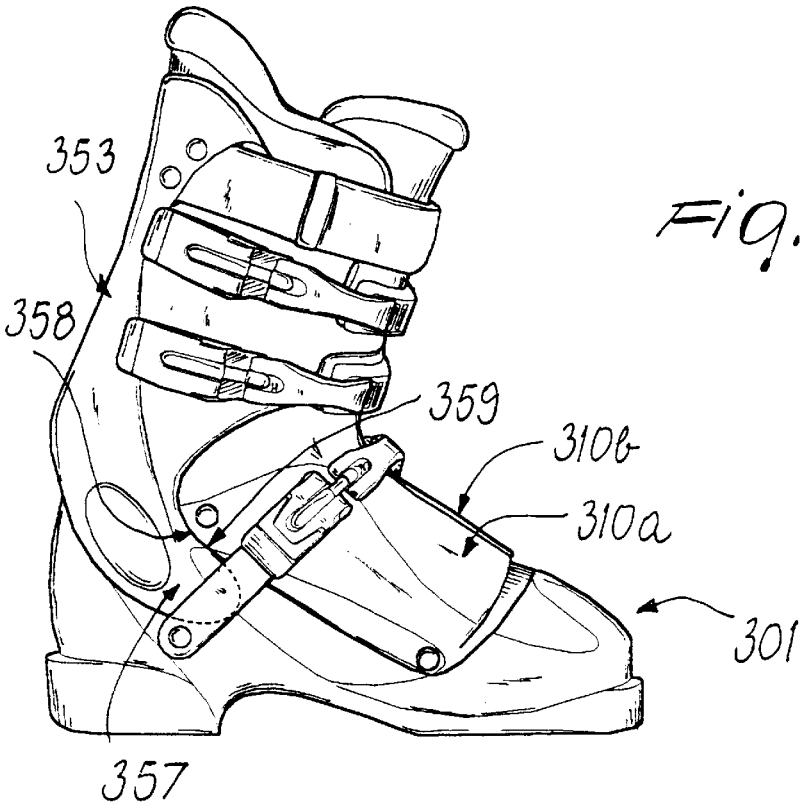
FIGS. 15–16 are side views of a ski boot according to a further aspect of the invention.
Figure 16:
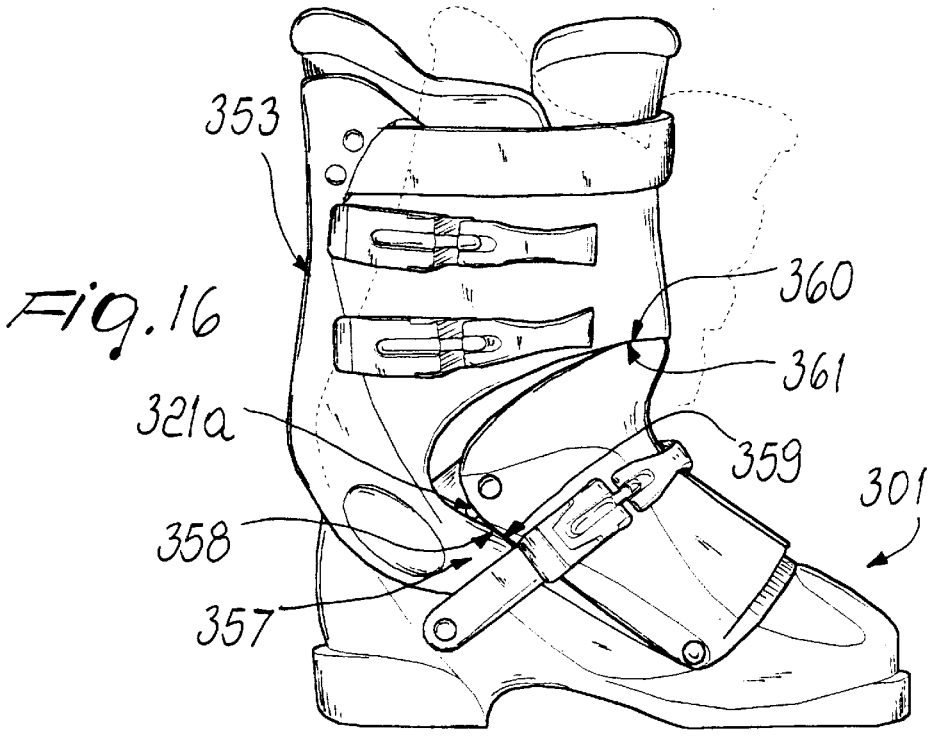

FIGS. 15 and 16 illustrate a second embodiment of a ski boot which comprises a quarter, designated by the reference numeral 353, which is associated with a shell 301.

A lifting and rotation means, designated by the reference numeral 357, for two flaps 310*a* and 310*b* is formed on the quarter 353 below the point where pivoting to the shell 301 occurs and proximate to the slots designated by the reference numerals 321*a* and 321*b.*

The lifting and rotation means 357 is constituted by two protrusions which protrude toward the tip of said shell 301 and whose upper perimetric edge, designated by the reference numeral 358, is arranged in contact with the facing lower perimetric edge 359 of said two flaps 310*a* and 310*b.*

The lifting and rotation means can be activated by arranging the quarter 353 vertically. The quarter can be locked in this position by resting the lower end, designated by the reference numeral 360, on the upper end 361 of said two flaps 310*a* and 310*b.*

Operation is thus as follows: with reference to the above cited figures, the foot of the user can be easily inserted in the boot simply by disengaging the closure devices 224, 255*a* and 255*b;* the first pressure applied by the foot as it enters causes the mutual spacing of the two flaps 210*a* and 210*b* and simultaneously lifts said plates about the region that is adjacent to the bridge 211.

The dual movement of the plates provides, without excessive efforts, a wide opening for the access of said foot.

Once the foot has been inserted, by acting on the closure device, the second pivots 219*a* and 219*b* are returned toward the lower ends of the slots 221*a* and 221*b* while increasing the overlap of the two flaps 210*a* and 210*b.*

The ski boot according to the embodiment of FIGS. 15–16 is even easier to put on, since the rotation of the quarter 353 in the vertical position entails the lifting and simultaneous rotation of the flaps 310*a* and 310*b* on the part of the two protrusions that constitute said lifting and rotation means.

Figure 17:
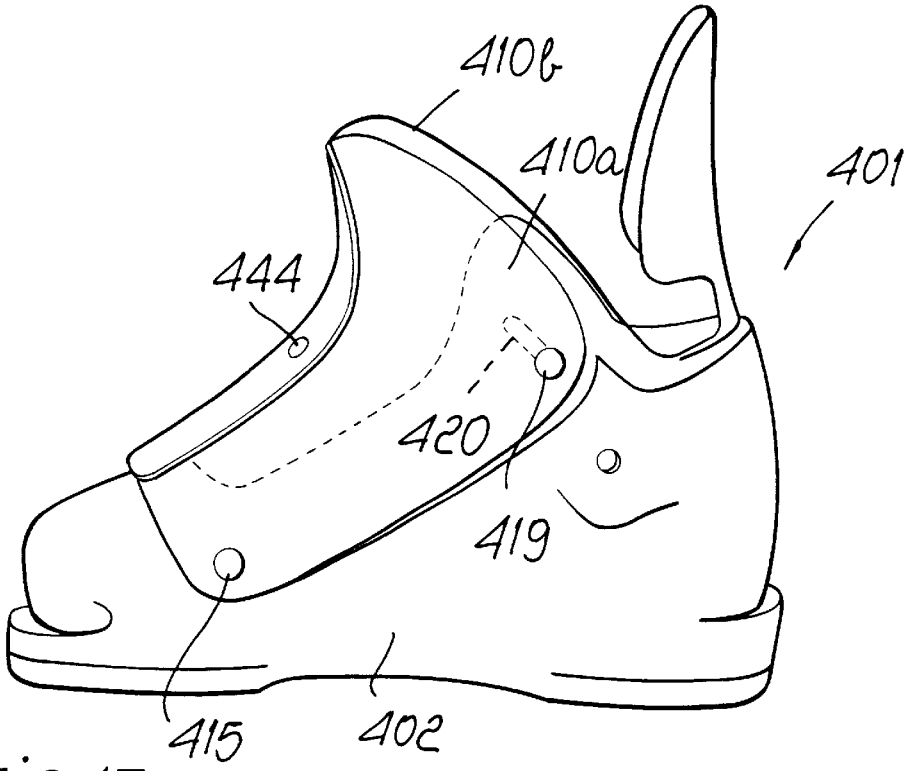
FIGS. 17–18 are side views of a shell according to a further aspect of the invention.
Figure 18:
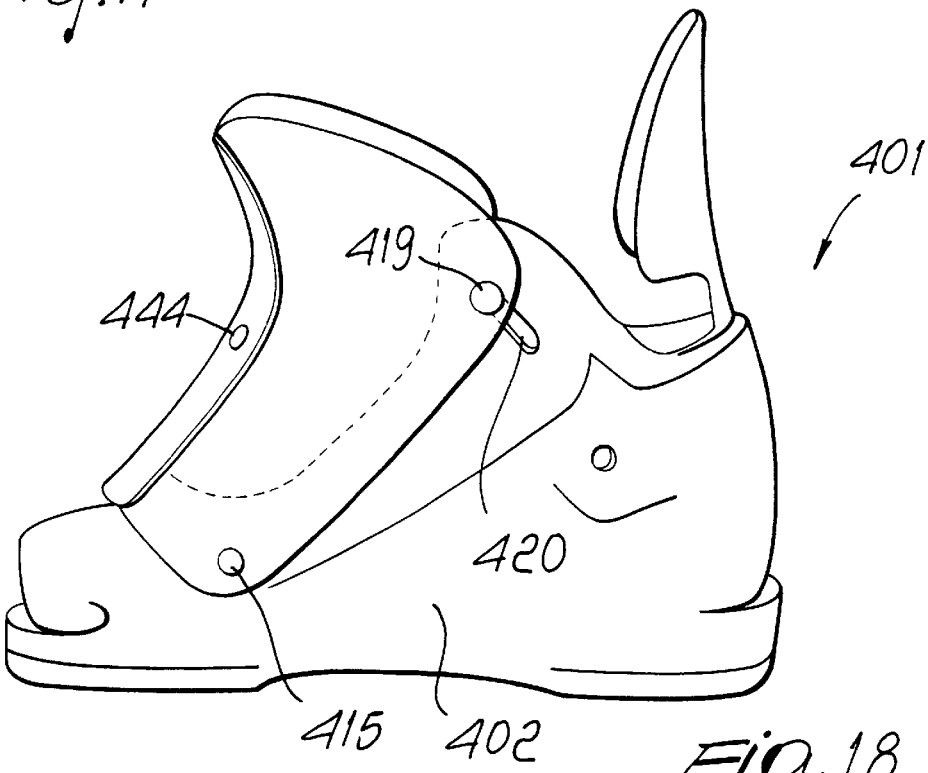
Figure 19:
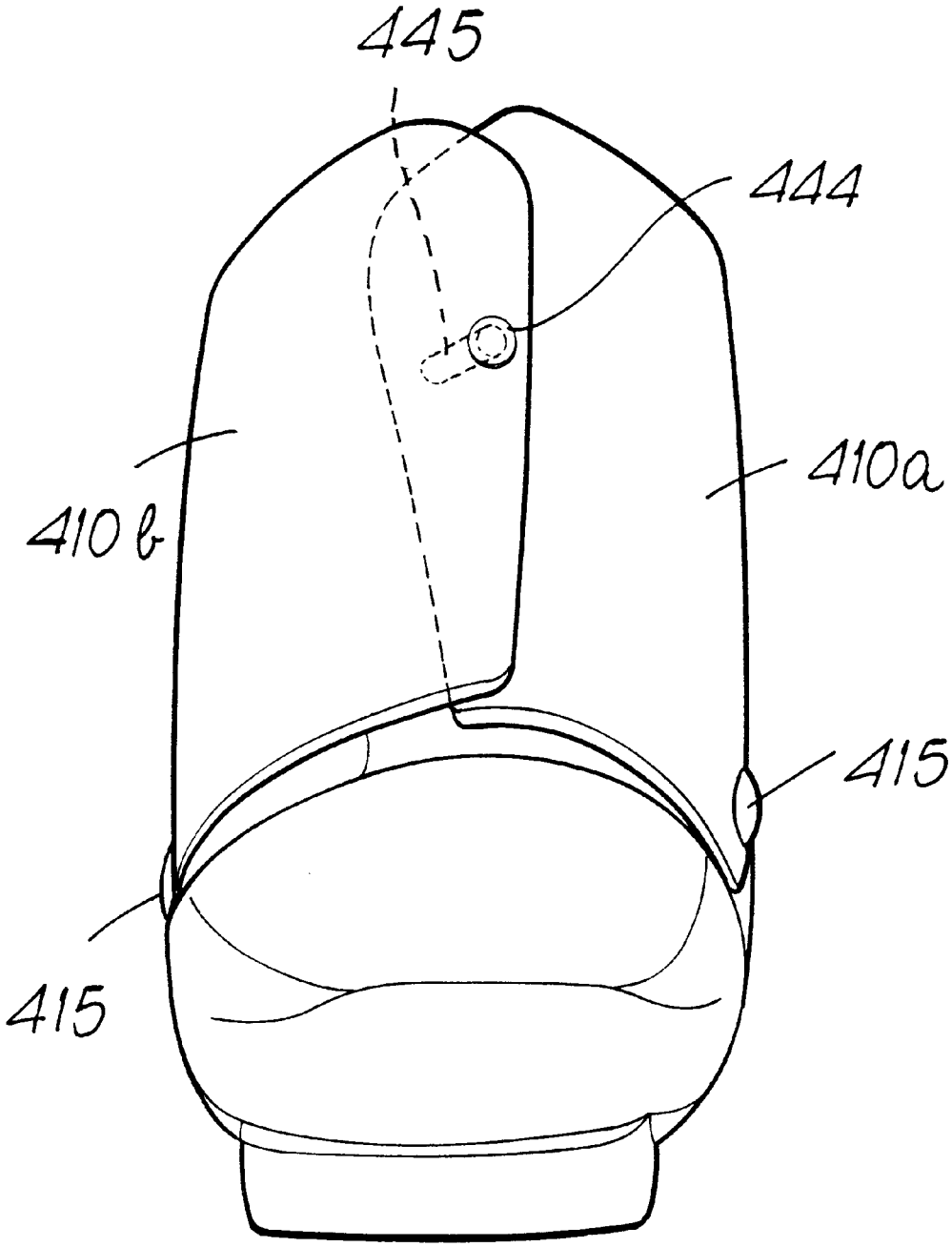
FIG. 19 is a front view of the shell of FIGS. 17–18.

FIGS. 17–19 illustrate a ski boot shell according to a further aspect of the invention and generally designated by the reference numeral 401.

The shell comprises a main body 402 having two overlapping flaps 410*a* and 410*b* in a manner similar to the embodiments described above.

The flaps 410*a* and 410*b* are associated with the main body 402 by means of a respective pivot, or screw, 415 and are mutually connected together by means of a stud 444.

Stud 444 is associated with flap 410*b* and engages a slot 445 provided on flap 410*a*. Slot 445 is arranged in order that, while the flaps 410*a* and 410*b* are brought forward, when the foot is inserted into the boot, stud 444 is at the end of slot 445 preventing the flaps 410*a* and 410*b* from separating from each other, as if the shell had a single flap.

Also during the backward motion, when the boot is closed on the foot, the flaps will behave in a similar manner, while, when fastening the boot, the flaps will get close together thus improving the enveloping of the foot by the shell and compensating the hollow regions created by the different shapes and dimensions of the feet.

Stud 444 may be provided in one piece with the respective flap improving the aesthetic appearance of the boot.

Flaps 410*a* and 410*b* are connected to the main body 402 also by means of pegs 419 associated with the flaps and adapted to slide in respective slots 420 provided in the main body 402 approximately at the rear end of the overlapping flaps 410*a* and 410*b.*

Figure 20:
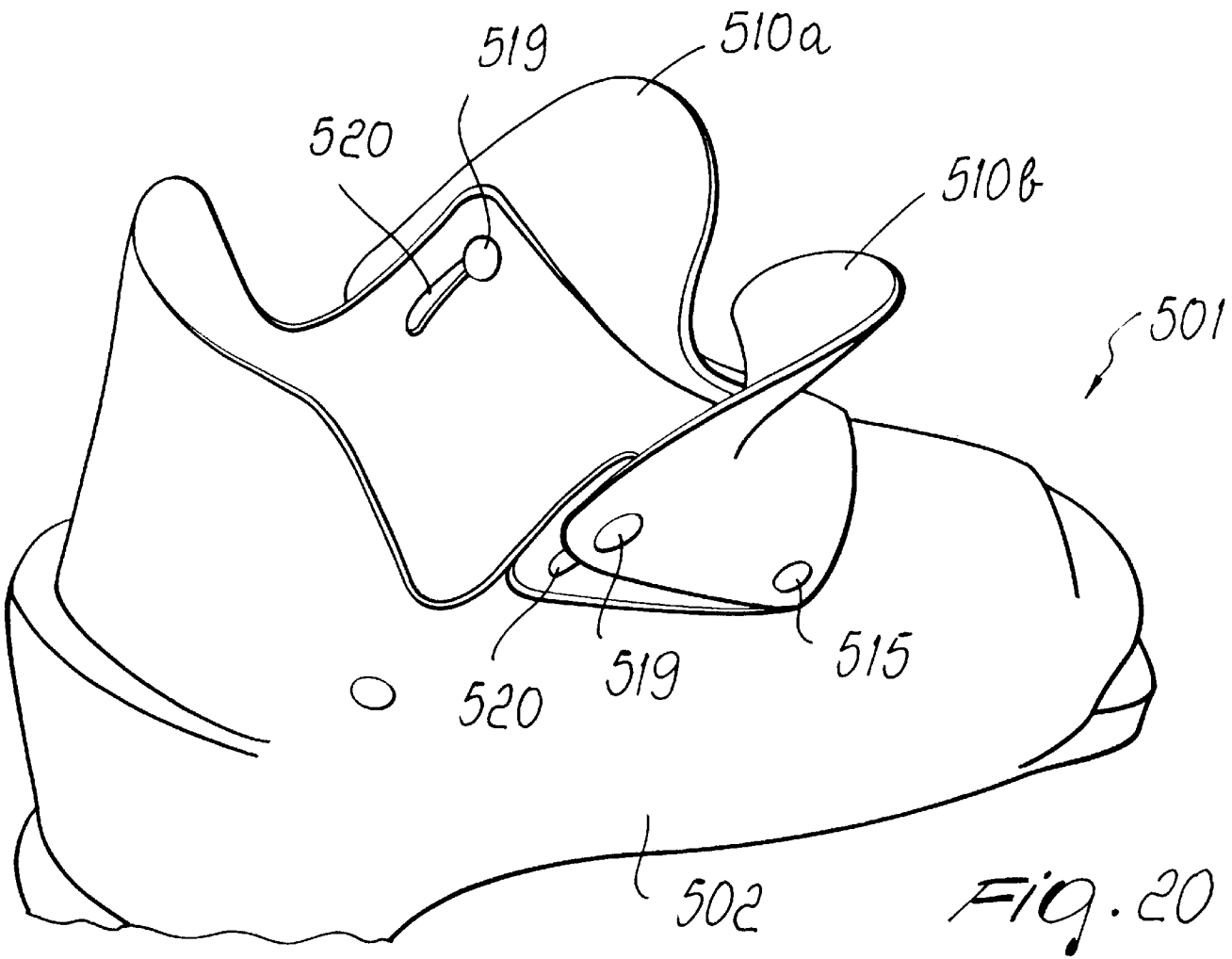
FIG. 20 is a perspective view of a shell according to a further aspect of the invention.

FIG. 20 illustrates a shell 501 similar to shell 401 but for a slightly different arrangement of the flaps 510*a* and 510*b* that are not connected by a stud as in the above-described shell.

Flaps 510*a* and 510*b* are rotatably connected to the main body 502 at about the central area of the foot rather than at the tip area as in the preceding embodiment. The absence of a stud improves the widening of the boot while inserting the foot. The maximum opening of the boot is a function of the length of the flaps 510*a* and 510*b.* Both flaps 510*a* and 510*b* are connected to the main body 502 also by means of pegs 519 associated with the flaps and adapted to slide in respective slots 520 provided in the main body 502.

Figure 21:
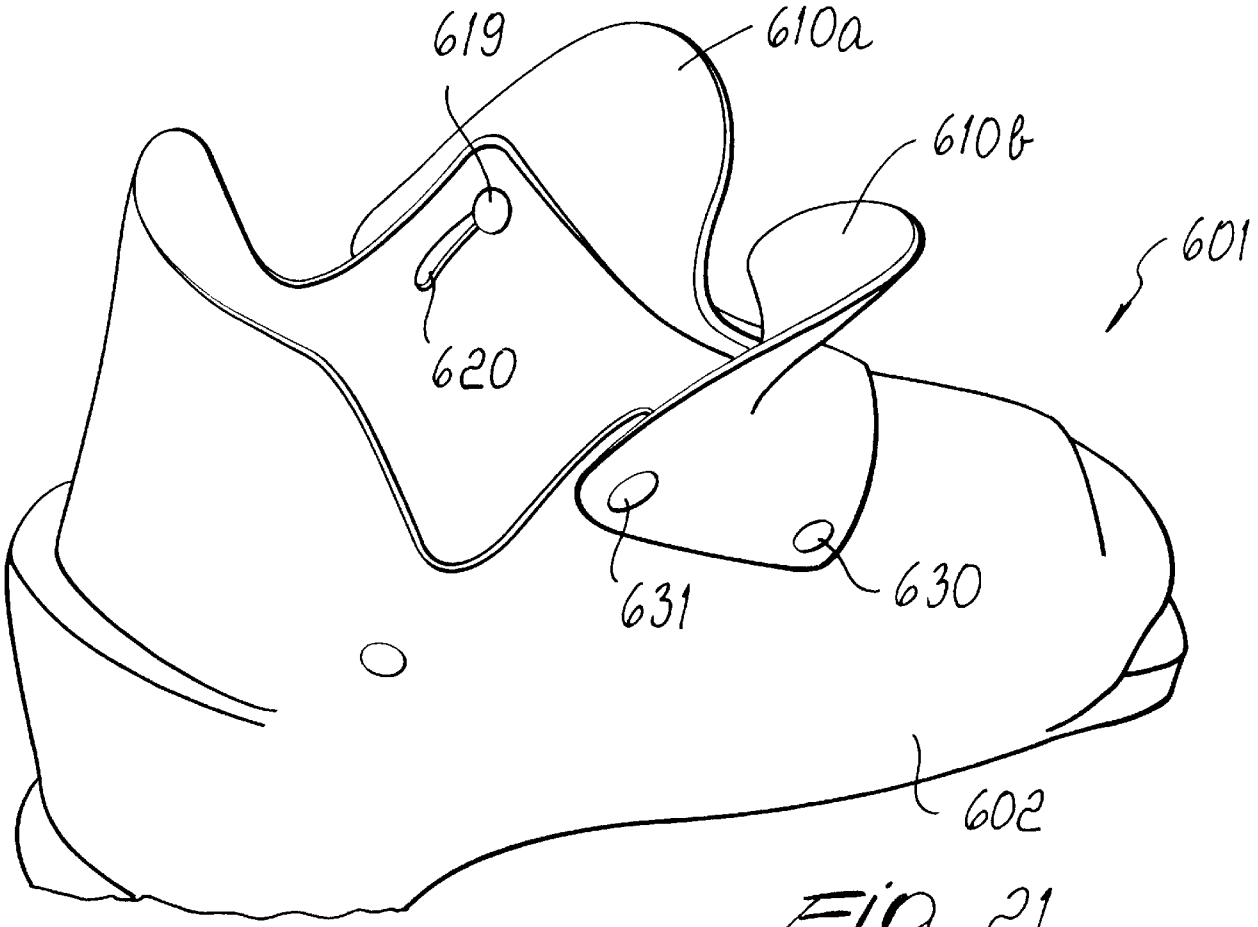
FIG. 21 is a perspective view of a shell according to still a further aspect of the invention.

FIG. 21 illustrates a shell 601 similar to shell 501 but wherein only one of the flaps, the left hand flap 610*a*, is connected to the main body 602 by means of a peg 619 associated with the flap and adapted to slide in slots 620 provided in the main body 602, while the other flap 610*b* is associated with the main body 602 by means of fasteners, such as rivets, 630 and 631.

The shell according to the invention may have further modifications and variations, within the scope of the appended claims. All the details may be replaced with technically equivalent elements and the materials employed, as well as the dimensions, may be any according to the specific needs and to the state of the art.

The disclosures in Italian Patent Applications No. MI2000A000518 and MI2000A000519 from which this application claims priority are incorporated herein by reference.

What is claimed is:

1. A shell, particularly for a ski boot, said shell comprising a main body which is open in an upward region such that said main body has an opening in the upward region thereof, and said main body having a longitudinal extension extending between a toe and a heel of said main body, and said main body having a vertical median plane and a top region arranged at said vertical median plane, said shell further comprising, at the foot instep region, two partially overlapping plate portions arranged at said opening in the upward region of said main body, each of said plate portions being rotatably pivoted to said main body by means of first rotary connection means arranged laterally to said main body distally from said vertical median plane and distally from said top region on an axis which is approximately parallel to a resting plane of a sole of said shell and which is transverse to said longitudinal extension of said main body such that each of said plate portions may rotate with respect to said main body respectively about said axis of said first rotary connection means, and the rotation of said two plate portions being limited by second guided connection means arranged in a region in front of said heel of said main body of said shell.

2. The shell according to claim 1, wherein said first rotary connection means comprises two hinges constituted by first pivots arranged laterally to said main body distally from said vertical median plane and distally from said top region and on an axis which is approximately parallel to the resting plane of said sole and adjacent to a front perimetric edge of each plate portion.

3. The shell according to claim 2, wherein said guided connection means comprises two second pivots associated with said plate portions and sliding within two respective slots formed at a front region of the heel approximately in a region above malleoli of said shell.

4. The shell according to claim 3, wherein each of said slots has a rectangular plan shape having a longitudinal axis orientated in a direction which is oblique with respect to the resting plane of said sole, thus allowing said plate portions to have a partial rotation defined by ends of said slots.

5. The shell according to claim 3, wherein each of said slots is shaped like a circular arc which is centered at said first pivot, thus allowing said plates to have a partial rotation defined by ends of said slots.

6. The shell according to claim 1, further comprising a closure device which comprises means for fastening said two underlying plates and a quarter which is rotatably associated with said shell and can rotate backward during opening.

7. The shell according to claim 3, wherein a quarter is rotatably associated with said shell in an upward region, a lifting and rotation means for said two plates being formed on said quarter below a point where pivoting to said shell occurs and adjacent said slots.

8. The shell according to claim 7, wherein said lifting and rotation means comprises two protrusions which protrude toward a tip of said shell and said two protrusions each having an upper perimetric edge which is arranged in contact with a respective facing lower perimetric edge of said two plates, said lifting and rotation means being activated by arranging said quarter vertically.

9. The shell according to claim 8, wherein when said quarter is placed in a vertical position, said quarter is locked in said vertical position by resting a lower end of said quarter on an underlying upper end of said two plates.

10. The shell according to claim 1, further comprising an arc-like elastically deformable bridge which frontally and transversely connects said two partially overlapping plate portions, said bridge abutting frontally against said shell and being arranged partially below said two plate portions.

11. The shell according to claim 10, wherein said bridge is connected at lateral ends thereof to each one of said two plate portions at connection regions provided at ends of front perimetric edges that cannot mutually overlap.

12. The shell according to claim 11, wherein said first rotary connection means comprises two first fixed pivots arranged within two respective first through holes which are formed laterally to said main body distally from said vertical median plane and distally from said top region adjacent to said connection regions.

13. The shell according to claim 11, wherein said guided connection means comprises two second pivots associated with said plate portions at two second through holes and sliding within two respective slots formed at a front region the heel approximately in a region above malleoli of said shell.

14. The shell according to claim 13, wherein each of said slots has a rectangular plan shape having a longitudinal axis orientated in a direction which is oblique with respect to the resting plane of said sole, thus allowing said plate portions to have a partial rotation defined by ends of said slots.

15. The shell according to claim 13, wherein each of said slots is shaped like a circular arc which is centered at said first pivot, thus allowing said plates to have a partial rotation defined by ends of said slots.

16. The shell according to claim 12, wherein a forward rotation of said plates is allowed by a deformability of said bridge proximate to said connection regions, said bridge being rigidly coupled to said main body by said first fixed pivots and abutting against a recess which is provided proximate to a tip of the shell.

17. The shell according to claim 16, wherein front ends of said two plates partially overlap each other and partially overlap said underlying bridge.

18. The shell according to claim 17, further comprising a closure device which comprises means for fastening said two underlying plates and a quarter which is rotatably associated with said shell and can rotate backward during opening.

19. The shell according to claim 13, wherein a quarter is rotatably associated with said shell in an upward region, lifting and rotation means for said two plates being formed on said quarter below a point where pivoting to said shell occurs and adjacent said slots.

20. The shell according to claim 19, wherein said lifting and rotation means comprises two protrusions which protrude toward a tip of said shell and said two protrusions each having an upper perimetric edge which is arranged in contact with a respective facing lower perimetric edge of said two plates, said lifting and rotation means being activated by arranging said quarter vertically.

21. The shell according to claim 20, wherein when said quarter is placed in a vertical position, said quarter is locked in said vertical position by resting a lower end of said quarter on an underlying upper end of said two flaps.

22. The tell according to claim 1, wherein said partially overlapping plate portions comprise two overlapping flaps each pivoted to said main body by means of respective pivots, a first one of said flaps having a stud adapted to engage a slot provided in the other one of said flaps.

23. The shell according to claim 22, wherein a second one of said flaps is connected to said main body also by means of a peg associated with the second flap and adapted to slide in a slot provided in the main body approximately at the rear end of the flap.

24. The shell according to claim 22, wherein said flaps are rotatably connected to the main body at a foot tip area of the shell.

25. The shell according to claim 22, wherein said flaps are rotatably connected to the main body adjacent a foot central area of the shell.

* * * * *